United States Patent [19]

Friedman

[11] 4,038,602

[45] July 26, 1977

[54] AUTOMODULATED REALTIVISTIC ELECTRON BEAM MICROWAVE SOURCE

[75] Inventor: Moshe Friedman, Washington, D.C.

[73] Assignee: The United States of America as represented by the Secretary of the Navy, Washington, D.C.

[21] Appl. No.: 661,208

[22] Filed: Feb. 25, 1976

[51] Int. Cl.[2] ..... H01J 25/02

[52] U.S. Cl. ..... 325/125; 328/227; 315/5; 331/82; 328/233; 325/130

[58] Field of Search ..... 325/130, 125; 328/227, 328/228, 229, 230, 233; 331/82; 315/3, 5

[56] References Cited

U.S. PATENT DOCUMENTS

| | | | |
|---|---|---|---|
| 2,312,919 | 3/1943 | Litton | 328/227 |
| 2,454,094 | 11/1948 | Rosenthal | 325/125 |
| 2,518,371 | 8/1950 | Ponte et al. | 325/125 |
| 3,292,239 | 12/1966 | Sadler | 315/5 |
| 3,463,959 | 8/1969 | Jory et al. | 315/5 |
| 3,558,967 | 1/1971 | Miriam | 315/3.5 |
| 3,916,246 | 10/1975 | Preist | 328/227 |

FOREIGN PATENT DOCUMENTS

| | | | |
|---|---|---|---|
| 648,705 | 9/1962 | Canada | 331/82 |
| 544,392 | 7/1957 | Canada | 331/82 |

*Primary Examiner*—Benedict V. Safourek
*Assistant Examiner*—Tommy P. Chin
*Attorney, Agent, or Firm*—R. S. Sciascia; Philip Schneider

[57] ABSTRACT

A relativistic electron beam device for producing high-power microwave radiation. The device comprises an electron beam injection gun, a drift chamber comprising a tube having a plurality of gapped resonant cavities along its length, means for converting the energy-modulated beam and means for extracting rf (microwave) radiation from the density-modulated, relativistic, electron beam.

15 Claims, 5 Drawing Figures

AUTOMODULATED REALTIVISTIC ELECTRON BEAM MICROWAVE SOURCE

BACKGROUND OF THE INVENTION

This invention relates to microwave electromagnetic (EM) energy generation and especially to a generator which produces high-power, EM energy from an electron beam in which the electrons are moving at relativistic speeds.

In the last few years, considerable interest has been shown in producing high-power rf radiation. This interest has arisen in part from recent developments in high-voltage technology and, particularly, the ability to produce relativistic electron beams with powers of $10^9$ to $10^{12}$ watts.

It is useful to classify microwave generators using electron beams into two categories. The first is generators using the "maser mechanism". Here, the amplification of the rf radiation is due to stimulated emission from an inverted population level. The second group of generators relies on an "aerial mechanism" (i.e., bunching). Here spatial and velocity nonuniformity in the electron distribution is needed.

Recent theoretical work indicates that nonlinear effects may play an important role in limiting the efficiency of a microwave maser to a few percent of the power available in a relativistic electron beam. The present device, which relies on the aerial mechanism, converts on the order of 20 percent of the electron kinetic energy in a relativistic electron beam into rf microwave radiation.

BRIEF SUMMARY OF THE INVENTION

The present device produces high-power, microwave, rf radiation from a relativistic electron beam by converting an energy-modulated electron beam to a density-modulated electron beam and thereafter extracting rf radiation from the density-modulated beam.

An object of this invention is to efficiently convert the energy of a relativistic electron beam into rf microwave radiation.

Other objects, advantages and novel features of the invention will become apparent from the following detailed description of the invention when considered in conjunction with the accompanying drawings wherein:

DETAILED DESCRIPTION OF THE INVENTION

Figure 1:
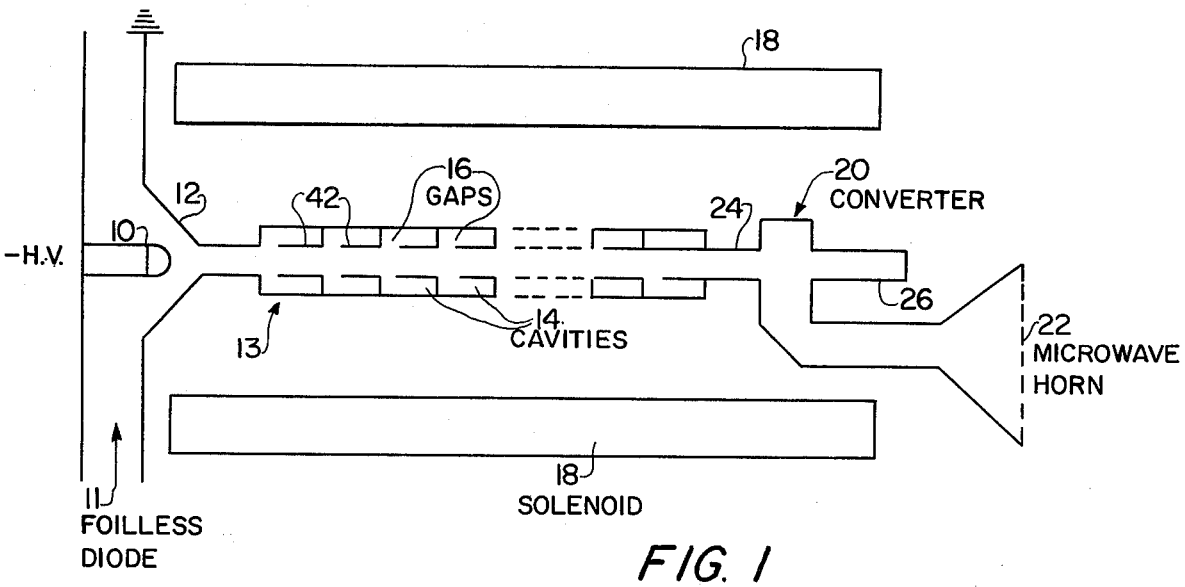
FIG. 1 is a schematic illustration of an embodiment of the present invention.

FIG. 1 shows an embodiment of the present invention which, basically, has three parts —firstly, there is an electron beam generator, or electron beam injection gun; secondly, there is drift chamber means containing a drift space for the electron beam, means to accelerate the electrons to relativistic speeds, means to energy-modulate the beam, and means to provide a dc magnetic field; thirdly, there is means to convert the energy-modulated relativistic, electron beam into a density-modulated electron beam and means to extract rf microwave radiation from the density-modulated electron beam.

The electron beam generator comprises a foilless diode 11, such as set forth in U.S. Pat. No. 3,700,495 to Friedman and Ury, and in The Review of Scientific Instruments, Vol. 41, No. 9, September 1970, pages 1334–1335.The generator comprises a cathode 10, to which a high, negative, pulsed voltage is applied, and an anode 12, which is grounded. The cathode is a smooth paraboloid with a roughly circular-band area that enhances electron emission, which is in the form of a hollow annular ring beam. The anode is a truncated cone with its cross-section being equal to that of the cathode along the cathode axis. The diode emits an electron beam of about 6 kiloamps and about 400 kilovolts for 50 nanoseconds. The average beam radius is 0.8 cm and its thickness (longitudinal) is 0.3 cm.

Figure 4:
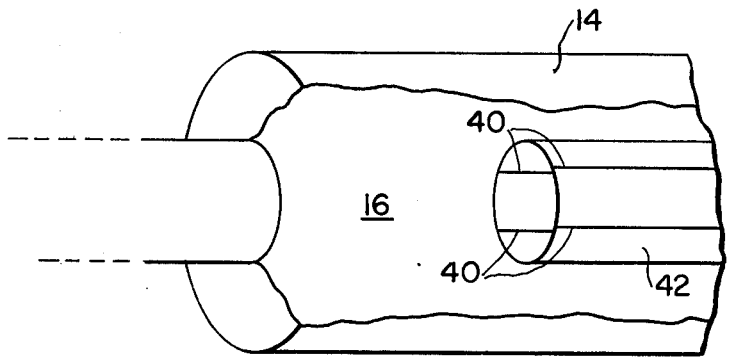
FIG. 4 is a schematic illustration of a cavity showing the slots cut in its inner wall.

The anode 12 connects with a drift tube 13 thru which the electron beam is projected. The drift tube is a hollow cylinder formed with resonant cavities 14, each having an interior gap 16 opening on the central space of the drift tube. The tube is made of a nonmagnetic, electrically conductive material, such as stainless steel. The dimensions of each cavity are 2.5 cm long with an O.D. of 3.4 cm. The tube is 1 m. long with an I.D. of 2.2 cm. This is also the I.D. of each cavity. The inside of the cavities of the drift chamber is coated with a high-electrical-conductivity material, such as gold, to a thickness of $2.5 \times 10^{-3}$ cm; if a more lossy, low-conductivity material is used, the cavity will not sustain rf oscillations. Slots 40 are cut in the walls 42 of each cavity 14 such that all modes of field propagation except the TEM mode are suppressed (see FIG. 4)

Figure 2:
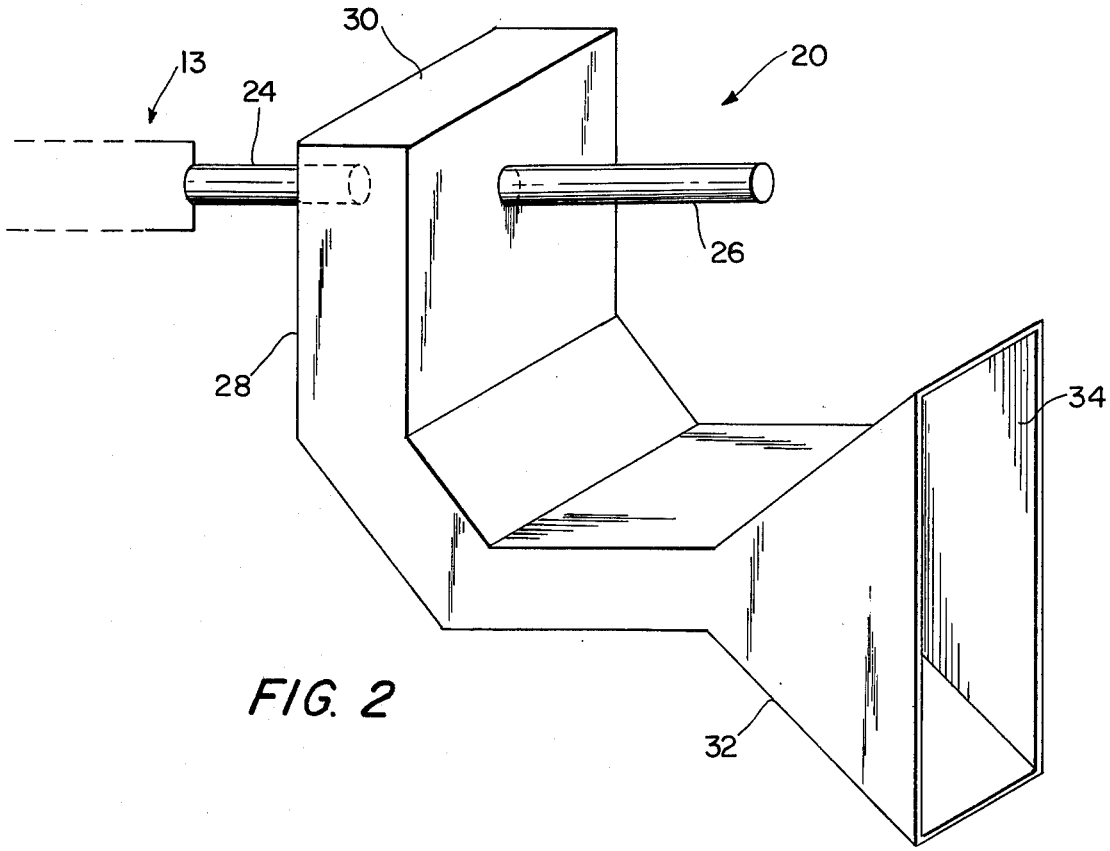
FIG. 2 is a more detailed, isometric view of the converter.

The converter 20, shown in more detail in FIG. 2, is made of rectangular waveguide 28. The end of the drift tube is separated into two sections 24 and 26. The beam crosses the waveguide 28 thru two holes located at the centers of the broad sides of the waveguide. One end 30 of the wwaveguide is shorted and the other is connected to a transmission horn 32 terminated in a sealed Lucite window 34. The whole device is evacuated to a base pressure of less than $2 \times 10^{-5}$ Torr and a dc axial magnetic field of 9 kilogauss is used to focus the electron beam. The field is provided by the solenoid 18 and may be pulsed so long as the pulse duration is longer than the duration of the pulsed electron beam.

Figure 3:
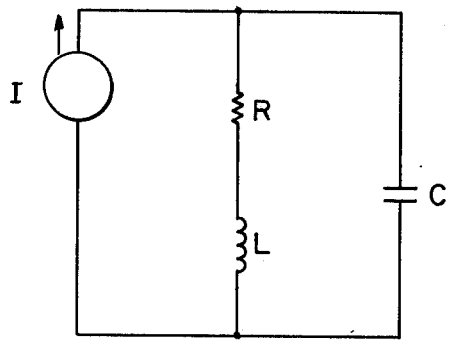
FIG. 3 is a circuit diagram of the equivalent circuit of each cavity.

The pulsed relativistic electron beam is efficiently modulated in energy as a result of an oscillating voltage V which is inductively induced by the beam return current. This current is forced to flow along the wall of a cavity, generating a voltage $V = L(dI/dt)$,where $L$ is the inductance associated with each cavity and $dI/dt$ is the rate of change of the return current (which is equal to the rate of change of the pulsed ralativistic electron beam). Since only TEM modes can exist in the cavity structure, the EM field in each cavity can be analyzed by means of the equivalent circuit (see FIG. 3) of each cavity. The cavity oscillates at a frequency $$f = \frac{1}{2\pi}\left(\frac{1}{LC} - \frac{1}{4}\ \frac{R^2}{L^2}\right)^{1/2}$$

and an amplitude $$V = L\frac{dI}{dt} + RI \approx L\frac{dI}{dt}.$$

The attenuation coefficient is $\alpha = \frac{1}{2}(R/L)$ where $L$, $C$ and $R$ are the inductance, capacity and wall resistance of the cavity. For the dimensions and materials used, $f \approx 3\text{GH}_z$ and $\alpha \approx 10^6 \text{sec}^{-1}$; $dI/dt \approx 2.5 \times 10^{12}$ A/sec yielding $V \approx 7\text{kV}$. $dI/dt$ near the first cavity is much larger than $dI/dt$ near the diode, due to the formation of a virtual cathode near the entrance to the cavity. It is probable that a much larger $dI/dt$ is developed further downstream.

In any period of oscillation each cavity oscillates with a frequency of 3 GHz and at least a 7 KV amplitude. The cavity first decelerates the beam for a half-period, removing an energy $\approx eL\ (dI/dt)$ from each electron. During the subsequent half-period, each cavity gives back the same amount of energy to each electron. Since the electrons are relativistic, a change of 7 keV in their energy will not affect their velocity. For this reason, the same electrons always lose energy while others always gain energy. The total effect of all cavities is to establish a modulation in the electron axial kinetic energy of $\gtrsim$ 140 KV amplitude. Thus, electrons exist in alternate groups at two different energy levels along the beam. However, there is no variation in density of the electrons (or current) along the beam length.

This process of passive interaction of the beam with the cavities to result in self-modulation of the beam is hereinafter called "passive modulation" or "self-modulation by interaction of the beam with the drift chamber". This is in contrast with the usual active modulation processes which employ external sources of modulating voltage or current to produce the field which acts on the beam.

Figure 5:
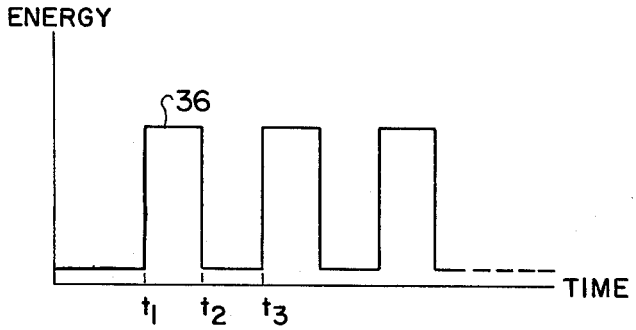
FIG. 5 illustrates the energy-modulated electron beam.

Unlike a conventional klystron, the modulation in beam energy cannot simply be converted into a density modulation by drifting the electron beam, since the electrons move with (approximately) the same speed no matter what their energies are. Here a different effect is used to obtain density modulation. It is well known that in order for an intense electron beam to propagate in a drift tube, considerable beam energy has to be invested in establishing electric and magnetic fields inside the drift region. Moreover, the electric field creates a potential hill thru which the electrons have to pass. The geometry of the drifting region and the beam current govern the height of the potential hill. By adjusting these parameters, only electrons with energy above a certain value will be able to propagate. Hence, this effect can convert an energy-modulated electron beam into a density-modulated beam. The energy-modulated electron beam can be portrayed as in FIG. 5, where the electrons are separated into alternate groups of high energy and low energy, 36 and 38 respectively. As a result of the potential hill at the entrance to waveguide 28, the low-energy groups fail to propagate, leaving only the high energy group to pass thru. The electron beam is then density-modulated since we have electrons from time $t_1$ to $t_2$ and no (or few) electrons from $t_2$ to $t_3$.

This is one of the principles upon which the converter works. The converter is made out of a waveguide, the volume of which must be filled with EM fields in order to support beam propagation. The holes in the waveguide are selected to coincide with the position of maximum intensity of the rf electric field in the waveguide, i.e. the position of maximum intensity of the *rf* electric field coincides with the position of the bunched electron beam. By doing this, the interaction between the beam and the *rf* field is maximized. The *rf* energy is then propagated to the outside by means of the microwave horn.

The converter thus acts to bunch the electrons, that is, to convert the energy-modulated electron beam to a density-modulated electron beam, and also to extract rf radiation from the density-modulated, relativistic electron beam.

The efficiency of operation and the power output can be increased by adding more converters after the first one.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A microwave rf radiation generator comprising, in combination:

pulsed electron-beam producing mean for producing an intense relativistic electron beam;

drift chamber means for energy-modulating said electron beam; and converter means, through which said beams propagates, for converting said energy-modulated, relativistic electron beam into a density-modulated, relativistic electron beam and for extracting rf microwave energy from said density-modulated beam.

2. A microwave generator as in claim 1, wherein:

said converter means comprises waveguide means coupled to the output of said drift chamber means.

3. A microwave generator as in claim 1 wherein:

said drift chamber means includes a longitudinal output section; and said converter means includes rectangular waveguide means which is connected to the output section of said drift chamber means through a hole in a broad side of said waveguide, said hole coinciding with the position of maximum electric-field intensity of an rf field in said waveguide.

4. A microwave generator as in cliam 1, wherein:

said drift chamber means comprises a tube having a plurality of resonant cavities along the inside of its wall, each said resonant cavity having a gap which opens upon the inner space of said tube, the inner wall of the resonant cavity structure being coated with a material of high electrical conductivity.

5. A microwave generator as in claim 3, wherein:

said converter means further includes a microwave horn connected to said rectangular waveguide.

6. A microwave generator as in claim 4, wherein:

said drift chamber is formed in three sections, a fore, center and aft section, said center section including said resonant cavities, and said fore and aft sections being of the same inner diameter as the inner diameter of said center section.

7. A microwave generator as in claim 6, wherein:

said drift chamber means is tubular and the inner walls of said cavities form a tube, the inner walls of said cavities being slotted so that all EM field modes, except the TEM mode, are suppressed in the drift chamber means.

8. A microwave generator as in claim 1, wherein:

said drift chamber means is tubular and the inner walls of said cavities form a tube, said inner walls being slotted to suppress all EM field modes in the drift chamber means except the TEM mode;

said drift chamber means includes a longitudinal output section; and said converter means includes rectangular waveguide means which is connected to the output section of said drift chamber means through a hole formed in a broad side of said waveguide, said hole coinciding with the position of maximum electric-field intensity of a rf field in said waveguide.

9. A microwave rf radiation generator comprising, in combination:

pulsed electron-beam-producing means for producing an intense relativistic electron beam;

drift chamber means for energy-modulating said electron beam by passive interaction of the beam with the drift chamber means; and converter means, through which said beam propagates, for converting said energy-modulated, relativistic electron beam into a density-modulated, relatvistic electron beam and for extracting rf microwave energy from said density-modulated beam.

10. A microwave generator as in claim 9, wherein:

said converter means comprises waveguide means coupled to the output of said drift chamber means.

11. A microwave generator as in claim 9, wherein:

said drift chamber means includes a longitudinal output section; and said converter means includes rectangular waveguide means which is connected to the output section of said drift chamber means through a hole in a broad side of said waveguide, said hole coinciding with the position of maximum electricfield intensity of an rf field in said waveguide.

12. A microwave generator as in claim 9, wherein:

said drift chamber means comprises a tube having a plurality of resonant cavities along the inside of its wall, each said resonant cavity having a gap which opens upon the inner space of said tube, the inner wall of the resonant cavity structure being coated with a material of high electrical conductivity.

13. A microwave generator as in claim 11, wherein:

said converter means further includes a microwave horn connected to said rectangular waveguide.

14. A microwave generator as in claim 12, wherein:

said drift chamber is formed in three sections, a fore, center and aft section, said center section including said resonant cavities, and said fore and aft sections having the same inner diameter as the inner diameter of said center section.

15. A microwave generator as in claim 14, wherein:

said drift chamber means is tubular and the inner walls of said cavities form a tube, the inner walls of said cavities being slotted so that all EM field modes, except the TEM mode, are suppressed in the drift chamber means.

* * * * *